United States Patent [19]

Malinowski

[11] 4,237,453

[45] Dec. 2, 1980

[54] SMOKE DETECTION SYSTEM AND METHOD

[76] Inventor: William J. Malinowski, P.O. Box 274, Bryantville, Mass. 02327

[21] Appl. No.: 23,033

[22] Filed: Mar. 23, 1979

Related U.S. Application Data

[63] Continuation-in-part of Ser. No. 824, Jan. 4, 1979.

[51] Int. Cl.[3] ..... G08B 17/10

[52] U.S. Cl. ..... 340/630; 250/574

[58] Field of Search ..... 340/630; 250/565, 574; 356/438, 439

[56] References Cited

U.S. PATENT DOCUMENTS

| | | | |
|---|---|---|---|
| 3,599,195 | 8/1971 | Boyko | 340/561 |
| 4,151,522 | 4/1979 | Yamauchi | 340/628 X |

FOREIGN PATENT DOCUMENTS

| | | | |
|---|---|---|---|
| 919640 | 2/1963 | United Kingdom | 250/565 |

*Primary Examiner*—John W. Caldwell, Sr.
*Assistant Examiner*—Daniel Myer
*Attorney, Agent, or Firm*—Morse, Altman, Oates & Bello

[57] ABSTRACT

A smoke detector is provided in which two light sources are employed in conjunction with a single photo responsive device and control circuit elements adapted for sequential operation of the light sources. One light source is directed at the photo responsive device to pre-bias the device while the other is directed at a smoke chamber to which the device is exposed. If smoke is present in the chamber, the light from the second source will strike the smoke particles and be reflected against the photo responsive device changing the output thereof. The light sources in one embodiment are timed to operate in a series of pulses and measurements are made on the declining output of the photo responsive device, such that the presence of smoke in the chamber will produce a longer decay time than will occur in the absence of smoke. A timer connected to the circuit measures the decay time and is adapted to generate a signal under the appropriate conditions.

7 Claims, 7 Drawing Figures

SMOKE DETECTION SYSTEM AND METHOD

CROSS-REFERENCE TO RELATED APPLICATION

This is a continuation in-part of U.S. application Ser. No. 824, filed Jan. 4, 1979 and entitled Smoke Detection System and Method.

BACKGROUND OF THE INVENTION

1. Field of the Invention

This invention relates generally to smoke detection and more particularly is directed towards a new and improved method and system for detecting the presence of an aerosol such as smoke using a small number of simple components arranged and operated in a highly efficient manner and with low power requirements.

2. Description of the Prior Art

Most optical smoke detectors now is use employ reflected light principles in which a light source is directed into an examination zone in which smoke is adapted to pass in the event of a fire. A photocell is also directed at the zone and is adapted to respond to light reflected from any smoke particles illuminated by the light source.

Reflected light smoke detectors of the sort described above typically function in either of two operating modes. In one mode, the light source is operated on a continuous basis which makes them impractical for battery powered units or for line powered units employing standby battery power. While detectors of this type are relatively simple to fabricate and can be highly sensitive, they are somewhat slow to react because of the response characteristics of the photo resistive cells generally used in this application.

The second mode of operation is one in which the light is pulsed in order to reduce current drain. While the pulsing type of smoke detector reduces current demand, photodectors of much faster response are required with a concurrent increase in cost. Also, the light source employed in the pulse type unit must be capable of higher output than one of a steady state detector. Further costs are incurred by the necessity of including an amplifier to compensate for the reduced photo gain of the high speed detector used in this type of system.

Accordingly, it is an object of the present invention to provide improvements in smoke detectors, especially low current drain smoke detectors.

Another object of this invention is to provide a battery powered smoke detector of simple, low cost construction characterized by high sensitivity and quick response.

A further object of this invention is to provide a novel method and associated system for detecting smoke.

Still another object of this invention is to provide means for compensating for thermal effects in a smoke detector.

SUMMARY OF THE INVENTION

This invention features the method of detecting smoke using a pair of light sources and a photo responsive device, comprising the steps of operating the light sources in a predetermined sequence while aiming one of the light sources directly at the photo responsive device to pre-bias the device and the other at a zone visible to the device whereby the presence of smoke particles in the zone will cause light from the other source to be reflected against the device. The output of the device is a waveform which will have one characteristic if no smoke is present and a different characteristic if smoke is present. The different characteristics are measured by timing different points of the waveform and generating a signal when the time exceeds a predetermined value.

The system include a photo responsive device directed towards a zone through which smoke will flow and a pair of light sources, one directed at the device in order to pre-bias the device and the other directed through the zone which is viewed by the device. In one embodiment, a control circuit operates the light sources in a timed sequence which selectively turns the light sources on and off so as to generate a waveform output from the device. A timer is connected to the circuitry for measuring different points along a declining waveform which will have one value when no smoke is present and if smoke is present, it will have a different value whereby the timer will detect the difference and generate a signal.

In a modification of the invention a second photo responsive device together with an adjustable light source are connected to the system in such a way to cancel thermal effects which would otherwise adversly alter the operating characteristics of the system.

DETAILED DESCRIPTION OF THE PREFERRED EMBODIMENTS

Figure 1:
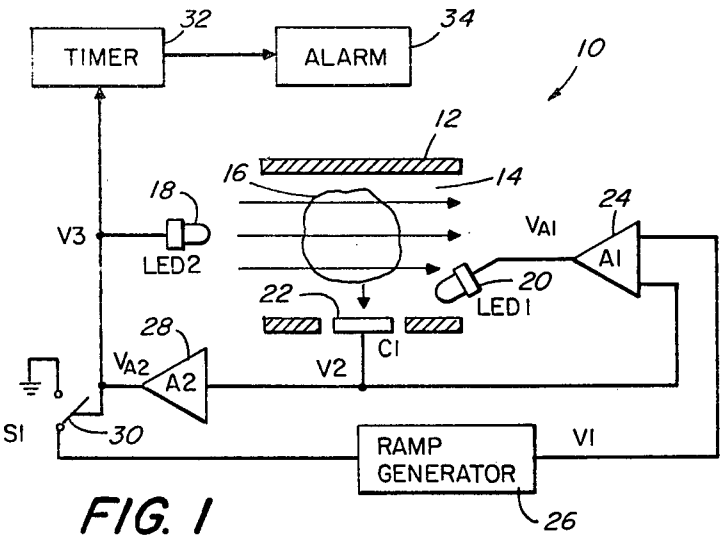
FIG. 1 is a schematic diagram of a smoke detector made according to the invention.

Referring now to the drawings and to FIG. 1 in particular, the reference character 10 generally indicates a smoke detection system organized about a housing 12 defining a chamber 14 which is open to ambient atmosphere but normally protected from ambient light conditions by known means. The chamber 14 is designed to provide an examination zone in which aerosols, such as smoke particles, may pass for detection purposes. In FIG. 1 a cloud of smoke particles is indicated at 16 and is adapted to be illuminated by a light source 18 which, in the preferred embodiment, is a light emitting diode. A second light source 20, which also may be a light emitting diode, is provided in association with the housing 12, but is directed a the cell of a photo responsive device 22 aimed at the interior of the chamber and adapted to respond to any light reflected from smoke particles illuminated by the light source 18.

The light source 20 is connected to the output of an amplifier 24 receiving inputs from a ramp generator 26 and the photocell 22. The photocell 22 also provides an input to an amplifier 28 which is a level detector with hysteresis. A switch 30 is connected to the outputs of the amplifier 28 and the ramp generator 26 for reasons that will presently appear. A timer 32 is connected to the output of the light source 18 and to the amplifier 28 and is adapted to provide an actuating signal which can be used to signal an alarm device 34.

The circuit operates in the following manner. Assuming that power, D.C., rectified line or battery, is applied in the manner illustrated in FIG. 2, the switch 30 is open. The ramp generator 36, which is formed by the resistor 36 and the capacitor 38, generates a voltage V1 which first begins to rise. The voltage V1 is compared with the output voltage V2 of the photo responsive device 22. Voltage V1 and V2 are applied to the amplifier 24, as shown. If the voltage V2 is lower than the voltage V1, then the amplifier 24 will energize the light emitting diode 20 which then shine directly against the face of the photo device 22, causing the voltage output V2 of the photo device to rise thereby prebiasing it. If the voltage V2 should then rise above the level of the voltage V1, the amplifier 24 will deenergize the light emitting diode 20. The amplifier 24 thereby maintains the voltage V2 at the increasing level of the voltage V1.

During this phase of the operating of the circuit, the voltage V2 will continue to rise until the trip level of the amplifier 28 is reached. As previously indicated, the amplifier 28 is a level detector with hysteresis. When the trip level of the amplifier 28 is reached, it will cause the switch 30 to close, and energize the light emitting diode 18. When the switch 30 closes, the voltage V1 will quickly drop below the level of the voltage V2 which will cause the light emitting diode 20 to be deenergized. The amplifier 28 will remain in this state until the voltage V2 drops below the reset level of the amplifier 28. Typically, this action will take place in about 100 MS.

If a sufficient amount of smoke 16 or other aerosol is present in the chamber 14, light from the light emitting diode 18 will reflect from the smoke particles in the cloud 16 with some of the reflected light falling upon the photo responsive device 22. The reflected light picked up by the device 22 will cause the voltage V2 to drop more slowly than would be the case if no smoke were present and no reflected light were impinging on the device 22.

The timer 32 functions to measure the two levels of the declining waveform output of the device 22, and, in this instance, if the increase in time of the declining voltage V2 exceeds 200 MS, then the timer 32 will actuate the alarm 34. If it does not exceed 200 MS the amplifier 28 resets itself and the entire sequence is repeated.

Figure 2:
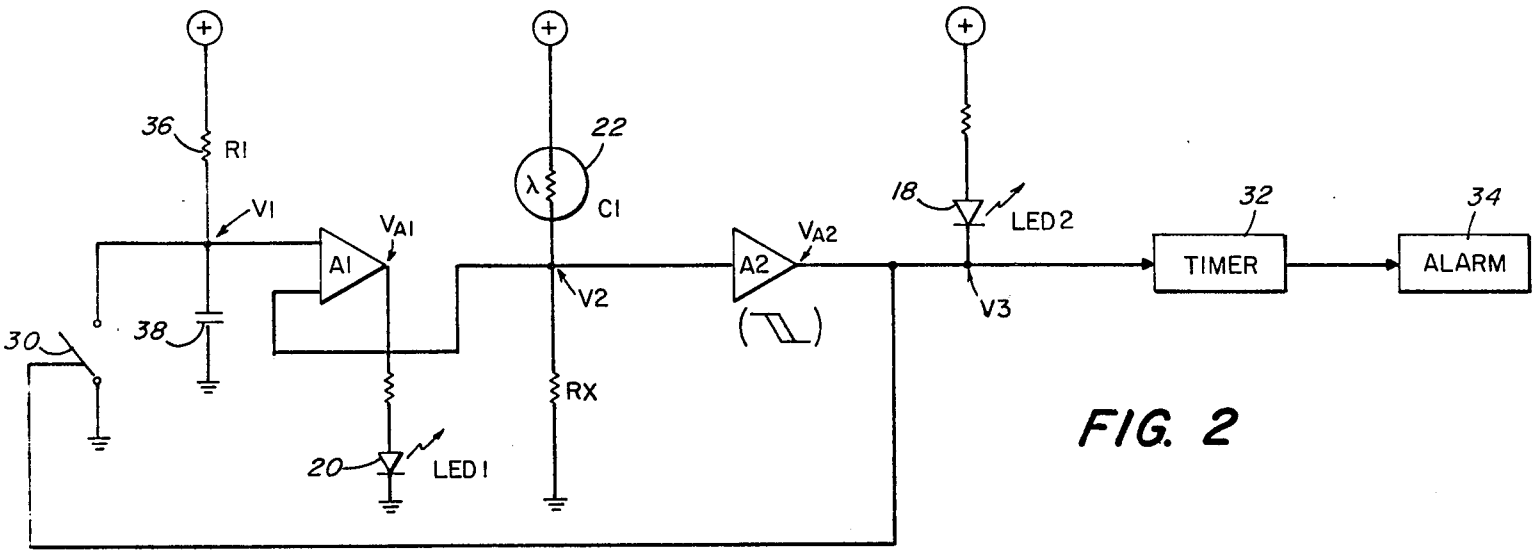
FIG. 2 is a circuit diagram of the FIG. 1 system.

The circuit of the sort shown in FIGS. 1 and 2 is characterized by very low power consumption and hence is ideally suited for battery powered application. Low power comsumption is achieved by the short operating time limits of the light sources. The light emitting diode 20 is positioned to shine directly against the photo responsive device 22 so that only microamps of current are required to provide sufficient output to drive the device to the desired level. Similarly, the light emitting diode 18 functions only for a relatively short period of time with a worst case operating interval typically being on the order of 0.2 seconds every 10 seconds, requiring an average current of 1/50 of normal. In this instance 1/50 of 5 MA would be involved which is 100 $\mu a$.

The technique employed allows the use of a relatively inexpensive and less sensitive photo responsive device than would otherwise be required. The tehcnique also takes advantage of the decay time of the photo responsive device which is faster than the rise time. Typically, the response characteristic of a photo responsive device, such as a cadmium sulfo-selenide device, would have an ascent time of 800 milliseconds, but a descent time of only 250 milliseconds. By utilizing the decay portion of the photodetector output, higher detection speed is achieved since the photo responsive device has been brought up to the alarm point by the light emitting diode 20 prior to the energization of the light emitting diode 18. Thus, no time is lost waiting for the device 22 to reach its peak output.

Figure 4:
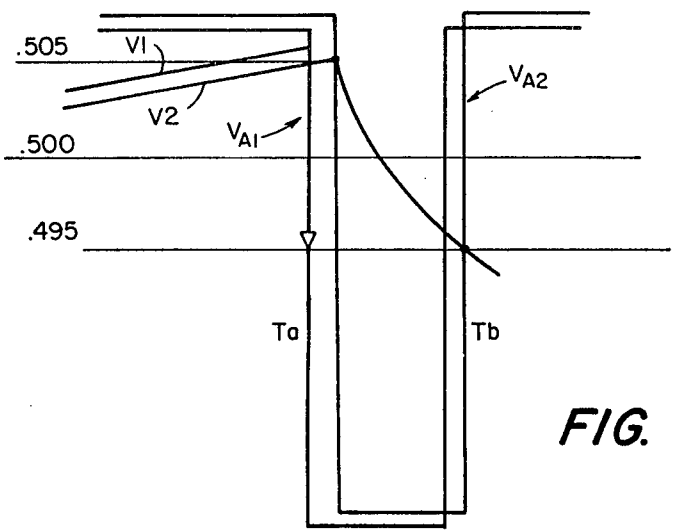
FIG. 4 is a diagram showing a magnified section of FIG. 3.
Figure 3:
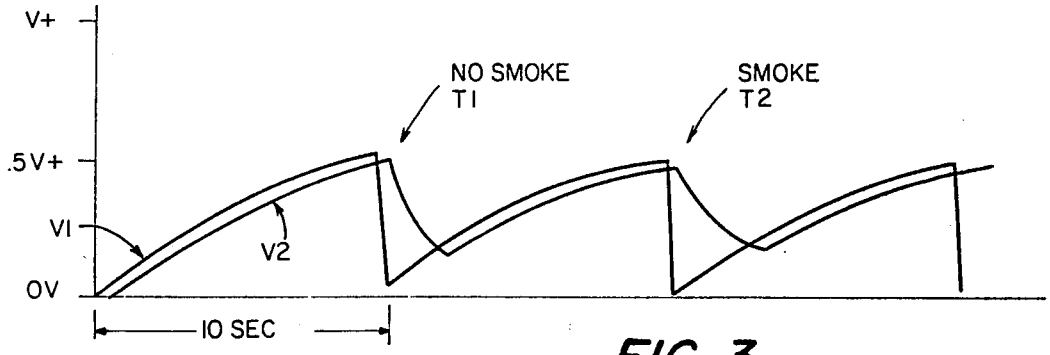
FIG. 3 is a waveform diagram illustrating the output of the photodetector under different conditions.
Figure 5:
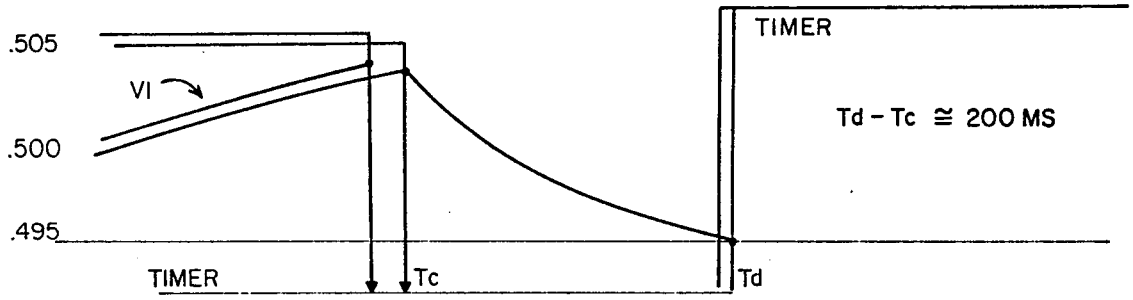
FIG. 5 is a diagram showing a different portion of the FIG. 3 diagram on an enlarged scale.

Referring now more particularly to FIGS. 3, 4 and 5, the voltages V1 and V2 are plotted to demonstrate the different decay characteristics of the photo responsive device output, first when no smoke is present in the chamber and secondly, when smoke is present in the chamber. The waveforms are shown slightly offset for the sake of clarity and no such time difference exists in practice. In FIG. 3 it will be noted that the waveform characteristic of the voltage V1 repeats itself since it is controlled by the fixed parameters of the ramp generator 26. V2, however, which is subject to change depending upon the presence or absence of smoke in the chamber, will display different decay characteristics. In the first decay waveform of V2, indicated by T1, no smoke is present and the decay displays a curve with a relatively sharp drop. However, in the next sampling cycle, assuming smoke is present at T2, the photo device will decay at a slower rate producing a more gradual curve, as shown.

In FIG. 4, T1 has been magnified and it will be seen that the voltages VA1 and VA2 are represented as the voltages at the output of the amplifier 24 and the amplifier 28, respectively, as shown in the drawings. The amplifier 28, when activated, drives voltages VA1 and VA2 to ground at time Ta, voltage V1 resets to ground and voltage V2 resets at time Tb, the time lapse between Ta and Tb being approximately 100 MS.

In FIG. 5 there is shown a magnified curve representing T2 on the FIG. 3 diagram. In FIG. 5 it will be seen that the decay curve of the voltage V2 extends between times Tc to Td from a peak to the voltage level 0.495. In this instance $Td-Tc=200$ MS, sufficient to generate a signal, since the timer has measured a excess of a predetermined value.

Figure 6:
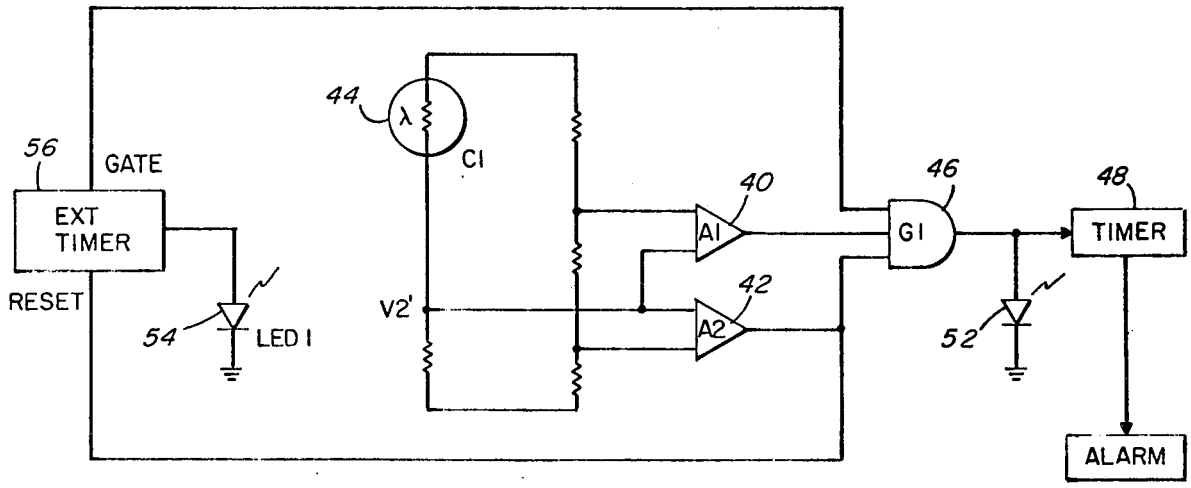
FIG. 6 is a schematic diagram illustrating a modification of the invention, and, FIG. 7 is a circuit diagram showing another modification of the invention.

Referring not to FIG. 6, there is illustrated a modification of the invention and, in this embodiment, another technique is shown for utilizing different points of a waveform for smoke detection purposes. In this embodiment amplifiers 40 and 42 form a window detector, the inputs to which are from a resistive network which includes a photo responsive device 44 having an output V2'. The amplifiers 40 and 42 provide an input to a gate 46 adapted to drive a timer 48 which in turn is connected to an alarm 50. A light emitting diode 52 is connected between the gate 46 and the timer 48 while another light emitting diode 54 is controlled by an external timer 56 which provides additional inputs to the gate 46.

The amplifiers 40 and 42 form a window detector and operate in such a manner that the photo responsive device 44 is maintained continuously above the highest threshold level providing a pre-biased condition similar to that in the principal embodiment. The external timer 56 or other control means, functions to deenergize the light source 54 whereby the voltage output of the device 44, represented by V2', will decrease until the upper threshold is reached. At this point, the gate 46 will switch and remain on until the lower level of the window is reached. At the lower level, the external timer 56 is reset and the gate 46 is inhibited.

Figure 7:
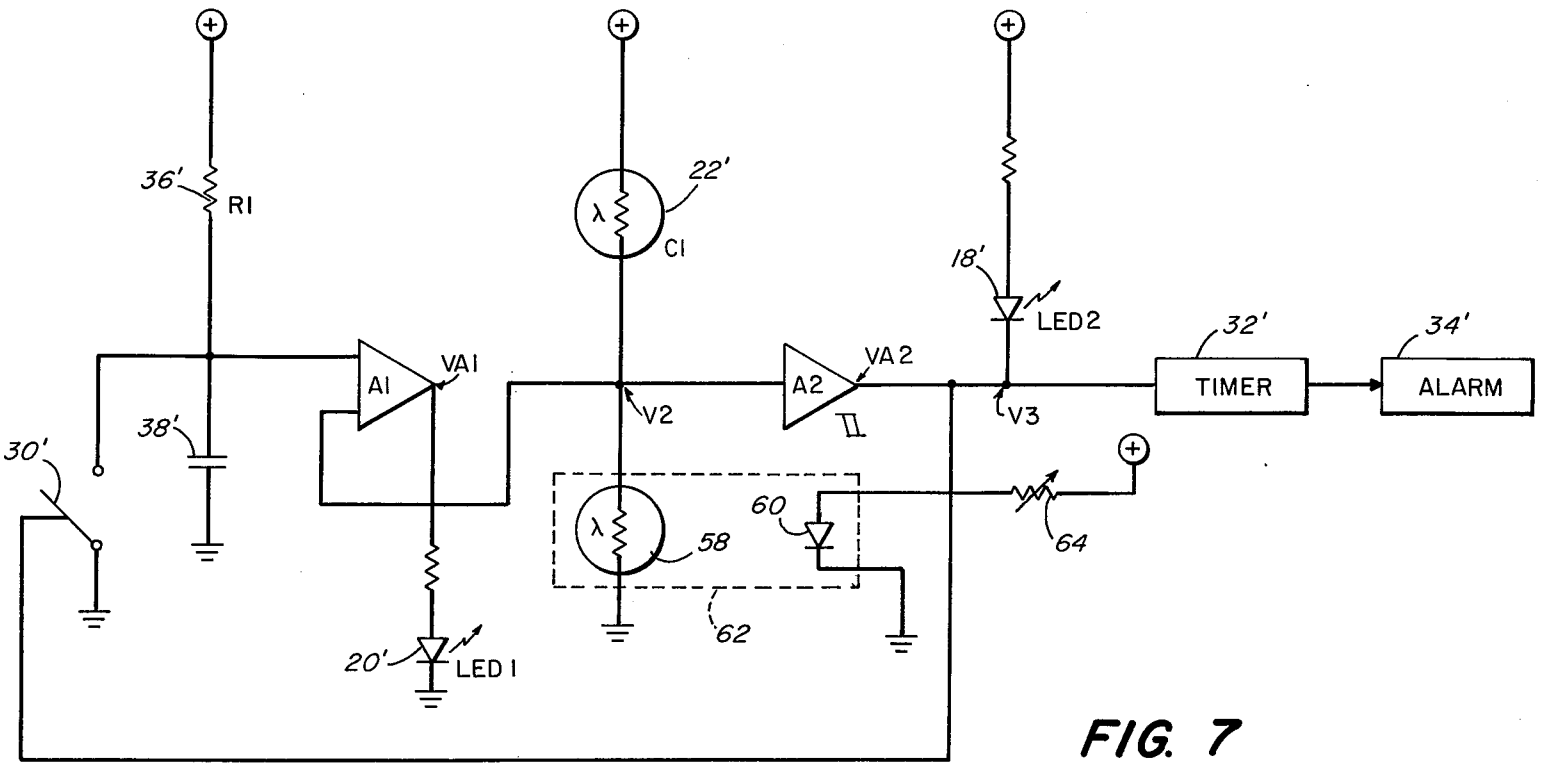

Referring now to FIG. 7 of the drawings there is illustrated another modification of the invention, and, in this embodiment, means are provided for compensating for ambient thermal effects. The circuit of FIG. 7 is similar to that of FIG. 2 except that RX is replaced by a second photo responsive device 58 exposed to a light source 60 such as an LED with both the device 58 and the source 60 mounted in an enclosed module 62.

In operation the LED 60 is biased on continuously while the two LED's 18' and 20' function on a time basis as described above in conjunction with the principle embodiment of FIGS. 1 and 2. The intensity of LED 60 is controlled by a variable resistor 64 which is adjusted so that the resistance of the photo responsive device 58 is made equal to the resistance of the photo responsive device 22' when smoke is present. The dual-cell circuit arrangement not only cancels out ambient thermal effects, but also provides a simple method for setting the sensitivity of the circuit by appropriate adjustment of the variable resistor 64. The circuit configuration also improves overall detector response since the operating current will be a fixed maximum value.

While the invention has been describe with particular reference to the illustrated embodiments, numerous modifications thereto will appear to those skilled in the art. For example, instead of cyclically pre-biasing the photo responsive device with a pulsing light source, the device could be maintained at a high level by a steady light source which may be periodically turned off as by a control unit when a second light source is turned on to illuminate any smoke that is present and the decay curve measured. Also, instead of measuring the decay curve, the system could be modified to measure different points along another part of the curve.

Having thus described the invention, what I claim and desire to obtain by Letters Patent of the United States is:

1. A system for detecting an aerosol such as smoke or the like, comprising (a) means defining an examination zone in which an aerosol is adapted to pass, (b) a photo responsive device mounted in position to monitor said zone and having an electrical output of a known duration when an aerosol is absent from said zone and having an electrical output of a different duration when an aerosol is present in said zone, (c) a first light source mounted in position to illuminate said device and second light source mounted in position to illuminate said zone and any aerosol therein, (d) control means operatively connected to said light sources and said photo responsive device for cyclically operating said light sources in closely timed sequence whereby a pulse of light from said first source will illuminate said photo responsive device to generate an electrical pulse of predetermined duration therefrom and a pulse of light from said second source will illuminate said zone and reflect against any aerosol present therein and onto said photo responsive device to extend the duration of said electrical pulse, (e) timing means connected to said device for measuring the duration of said output, (f) alarm means connected to said timing means and adapted to be actuated by said timing means in the event that the duration of said output is beyond said known duration, (g) a second photo responsive device connected to said first device, (h) second light means illuminating said second device, and, (i) adjustment means connected to said second light means for adjusting the output thereof until the resistance of said second device corresponds to that of said first device when an aerosol is present.

2. A system according to claim 1 wherein said control means includes a ramp generator for energizing said first light source and comparator means connected to said ramp generator and said photo responsive device for operating said first light source between predetermined output levels of said photo responsive device.

3. A system according to claim 2 wherein said control means includes a level detector connected to said photo responsive device and to said second light source and adapted to energize said second light source when the output of said photo responsive device reaches a predetermined value.

4. A system according to claim 3 including switch means responsive to said level detector for denergizing said first light source when energizing said second light source.

5. A system according to claim 3 wherein said level detector is an amplifier with hysteresis.

6. A system according to claim 1 wherein said light sources are light emitting diodes.

7. A system according to claim 1 wherein said photo responsive device displays a response time characteristic of a relatively slow ascent and a relatively fast descent.

* * * * *